US010226111B2

(12) United States Patent
Cella et al.

(10) Patent No.: US 10,226,111 B2
(45) Date of Patent: Mar. 12, 2019

(54) GEM APPLICATOR ASSEMBLY

(71) Applicant: GEMC2, LLC, Cochranville, PA (US)

(72) Inventors: Angie Cella, Cochranville, PA (US); Federico Diaz, Sleaford (GB); Matthew Mercier, Windermere, FL (US); John Burrill, Gotha, FL (US)

(73) Assignee: GEMC2, LLC, Wilmington, DE (US)

( * ) Notice: Subject to any disclaimer, the term of this patent is extended or adjusted under 35 U.S.C. 154(b) by 0 days.

(21) Appl. No.: 15/267,160

(22) Filed: Sep. 16, 2016

(65) Prior Publication Data

US 2017/0000225 A1 Jan. 5, 2017

Related U.S. Application Data

(60) Provisional application No. 62/220,490, filed on Sep. 18, 2015, provisional application No. 62/301,665, filed on Mar. 1, 2016.

(51) Int. Cl.
*A45D 8/00* (2006.01)
*B44C 1/28* (2006.01)

(52) U.S. Cl.
CPC ..... *A45D 8/00* (2013.01); *B44C 1/28* (2013.01); *A45D 2008/008* (2013.01)

(58) Field of Classification Search
CPC ..... A44C 15/006; B29C 65/48; B29C 66/748; A45D 8/00; A45D 2008/008; B29L 2031/718; B44C 1/28
USPC ..... 132/133
See application file for complete search history.

(56) References Cited

U.S. PATENT DOCUMENTS

2007/0028942 A1* 2/2007 Leung ..... A45D 2/00 132/333
2010/0088794 A1* 4/2010 Oradini, Sr. ..... A41D 13/087 2/21

OTHER PUBLICATIONS http://www.kmart.com/conair-guick-gems/p-01319976000P?sid=KDx01192011x000001&gclid=EAIaIQobChMIhtjqj_iv2wIVTyWBCh2ScQwDEAQYBSABEgJP1PD_BwE&gclsrc=aw.ds#; https://www.youtube.com/watch?v=EAR0WOUKysc (Year: 2014).*

* cited by examiner

*Primary Examiner* — Gene O Crawford
*Assistant Examiner* — Ayodeji T Ojofeitimi
(74) *Attorney, Agent, or Firm* — Massina Patent & Trademark Law

(57) ABSTRACT

A gem applicator assembly including a dispenser supporting a plurality of gems and an applicator. Each gem has an adhesive backing. The applicator includes a body with a support assembly supported by the body and configured to receive and support the dispenser with one of the gems aligned with an application target area. A plunger having a push rod is supported by the body and movable relative thereto between an initial position and an application position wherein the push rod engages the aligned gem and pushes the gem such that the adhesive backing of the aligned gem moves toward the application target area. The gem dispenser may include a belt having a strip configuration with a plurality of spaced apart gem openings extending through the belt. Each gem is aligned with a respective gem opening.

22 Claims, 7 Drawing Sheets

GEM APPLICATOR ASSEMBLY

This application claims the benefit of U.S. Provisional Application No. 62/220,490, filed on Sep. 18, 2015, and U.S. Provisional Application No. 62/301,665, filed on Mar. 1, 2016, and the contents of each are incorporated herein by reference.

FIELD OF THE INVENTION

This disclosure relates to application of gems to hair, ribbons, notebooks, dolls hair, artwork, paper, cloth and other items. More particularly, the invention relates to a gem applicator configured to apply gems and a dispenser configured to support the gems for application.

BACKGROUND OF THE INVENTION

There are two companies marketing 'gems' for hair. One device uses batteries to affix a spring-loaded plastic jewel to the hair. The child has to manually insert each jewel into the device and then they need to have an adult help them to remove the jewels—it can damage the hair. The other device utilizes gems sold in sheets which are applied to the hair using a heating element, such as a flat iron. Both require electricity and significant effort either in applying or in removing the gems.

SUMMARY OF THE INVENTION

In at least one aspect, the present invention provides a gem applicator which provides the ability to apply gems more easily and with much more versatility. It is a simple and affordable handheld device that efficiently and quickly applies crystals, rhinestones or other gems (with adhesive already on them) to the hair, paper, cloth, etc. (material) without heat, batteries, or electricity and without any damage to the hair. Simply place a section of the material into the application area of the device, squeeze the trigger and the gem is applied. In the case of gems applied to hair, the gems may be removed by simply brushing them out.

In at least one embodiment, the present invention provides a gem applicator assembly including a dispenser supporting a plurality of gems and an applicator. Each gem has an adhesive backing. The applicator includes a body with a support assembly supported by the body and configured to receive and support the dispenser with one of the gems aligned with an application target area. A plunger having a push rod is supported by the body and movable relative thereto between an initial position and an application position wherein the push rod engages the aligned gem and pushes the aligned gem such that the adhesive backing of the aligned gem moves toward the application target area. The gem dispenser may include a belt having a strip configuration with a plurality of spaced apart gem openings extending through the belt. Each gem is aligned with a respective gem opening.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
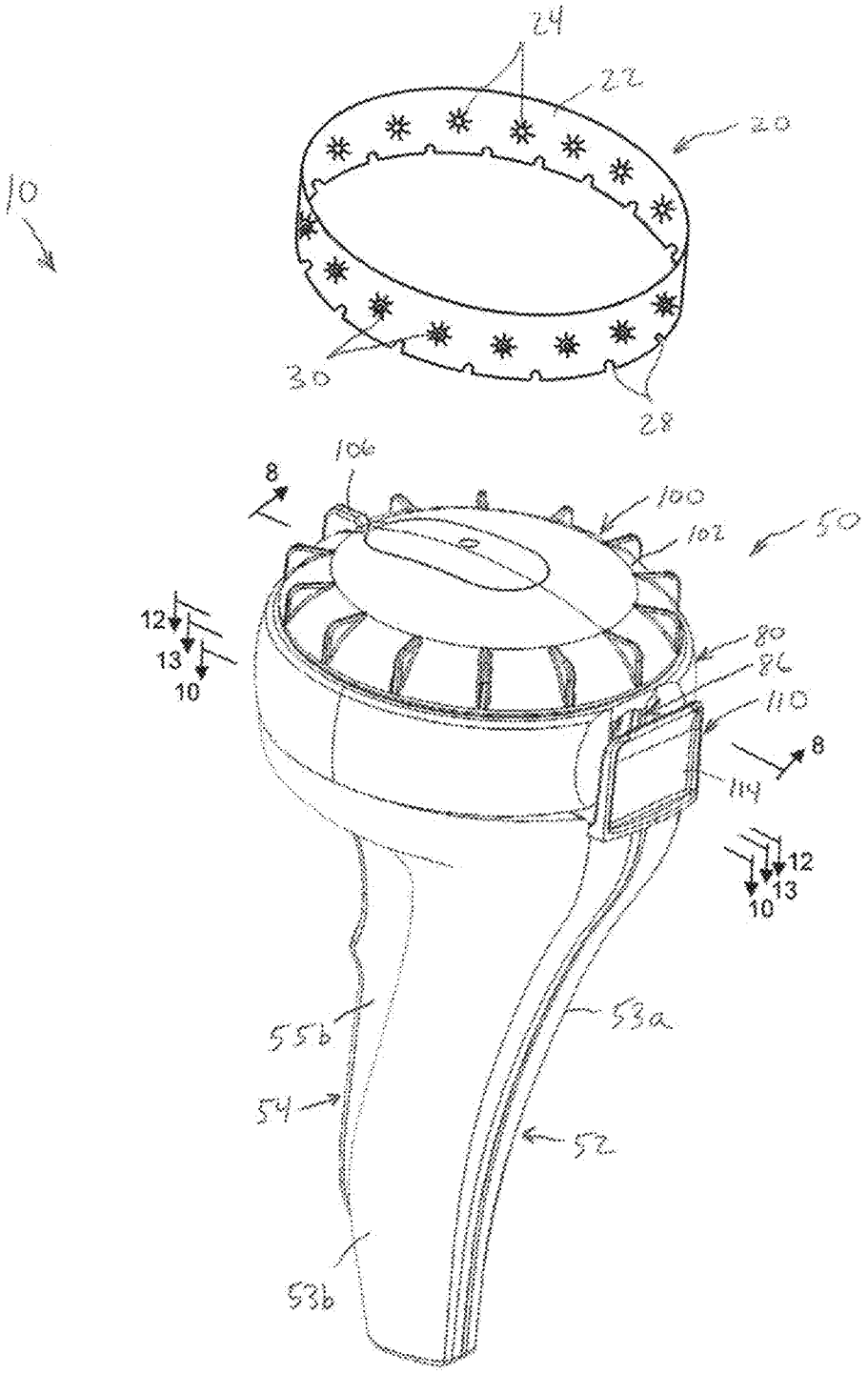
FIG. 1 is a perspective view of a gem applicator assembly in accordance with an embodiment of the invention including an exemplary applicator and an exemplary dispenser.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to the figures, exemplary embodiments of a gem applicator assembly 10 in accordance with the disclosure will be described. As used herein, the term gem encompasses items of various shapes and sizes and made from various materials including natural and synthetic materials, including crystals, plastics, rhinestones, glass beads, pearls and the like. The gems have an adhesive which causes them to adhere to the intended material. In applications wherein the gems are applied to hair, the adhesive is selected such that it is safe for hair and skin.

Figure 6:
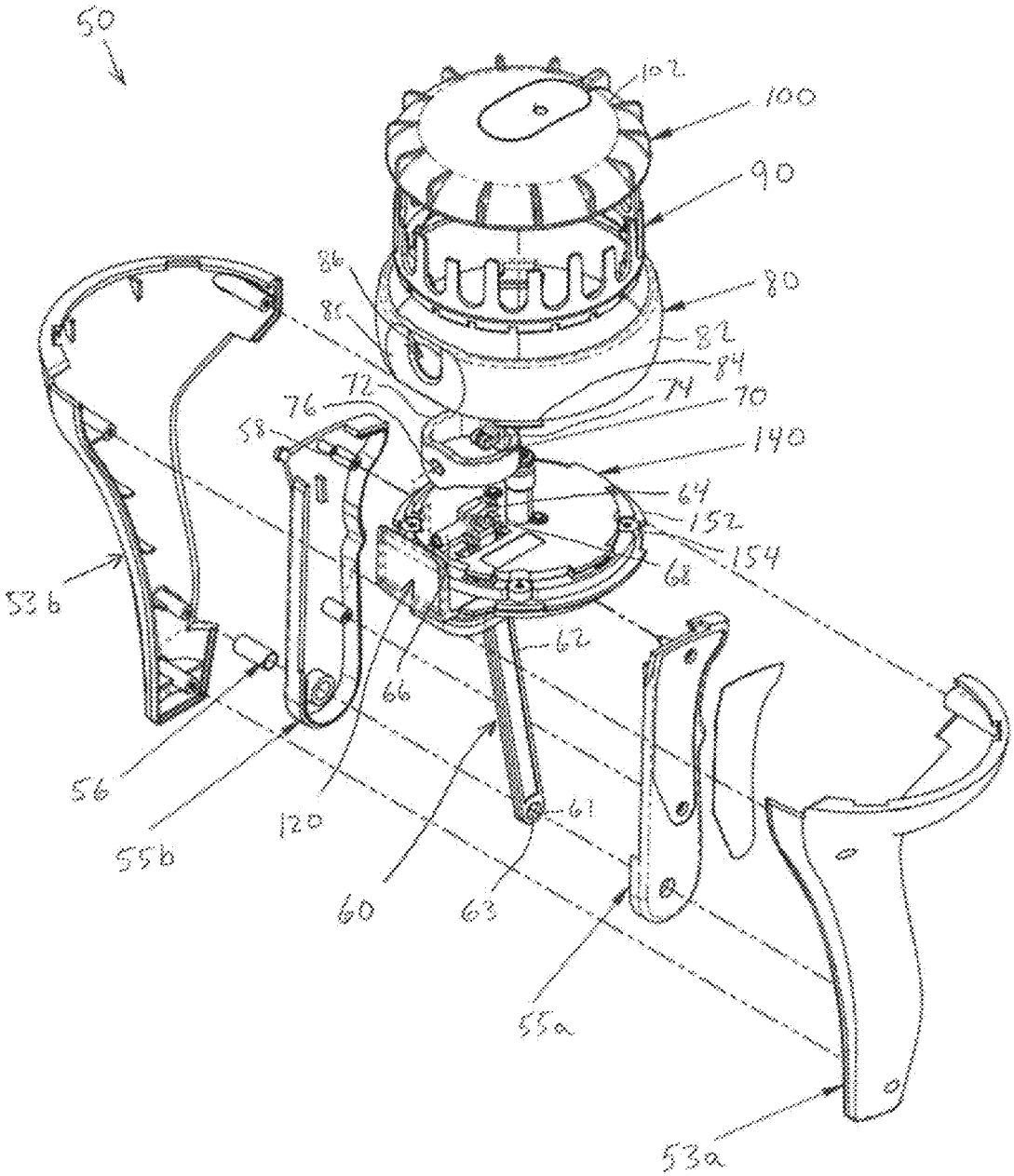
FIG. 6 is an exploded perspective view of the applicator of FIG. 1.

Referring to FIGS. 1 and 6, the exemplary gem applicator assembly 10 generally comprises a gem dispenser 20 and a gem applicator 50. The gem applicator 50 is a purely mechanical device, to facilitate applying gems, for example, crystals, to hair, paper, cloth and or other materials (application target). In the present embodiment, the gem dispenser 20 is in the form of a belt which will be easily inserted into the applicator 50 via a removable cover assembly 100. The removable cover assembly 100 provides an easy operation to replace the gem belt 22 so that, for instance, the user can change the color, shape and size of the gem the user wants to apply next. The applicator assembly 10 will cater for gems 30 of different size and shapes, thus making it more versatile in its use.

The applicator 50 includes a hollow handle body 52, an outer ring 80 supported on the handle body 52, and the cover assembly 100. The belt 22 is supported by a belt drum 90 which is within a drum cover 80. The internal belt drum 90 is engaged by the cover assembly 100 such that rotation of the cover 102 causes rotation of the belt 22 to align a gem 30 with an opening 86 in the drum cover 80. Such a manual rotation of the belt 22 allows a user to align a desired gem 30 with the opening 86 to apply the desired gem 30. This may also be useful where a belt 22 has some of the gems 30 missing, for example, the gems have already been used, and the user wants to advance the belt 22 to the next gem 30 that can be applied. As will be described in more detail hereinafter, the applicator 50 may include an indexing assembly 140 to automatically advance the belt 22 in addition to or in place of the manual rotation.

To apply a gem 30, the applicator 50 operates with a trigger 54 pivotally supported by the handle body 52. The trigger 54 pushes a plunger 60 (see FIG. 6) which in turn presses a gem 30 through the outer ring opening 86 and against the location on the hair or other material where it is wanted. In order to press the gem firmly against the hair, so that it stays in place long enough, a portion of the applicator 50 serves as a backing plate 114 to press the gem against the hair. The trigger mechanism may serve a double function whereby it is also part of the indexing assembly such that it advances the belt with gems one position, each time it is pressed. Such allows the user to install the gems in succession, one each time the trigger is pressed.

Figure 2:
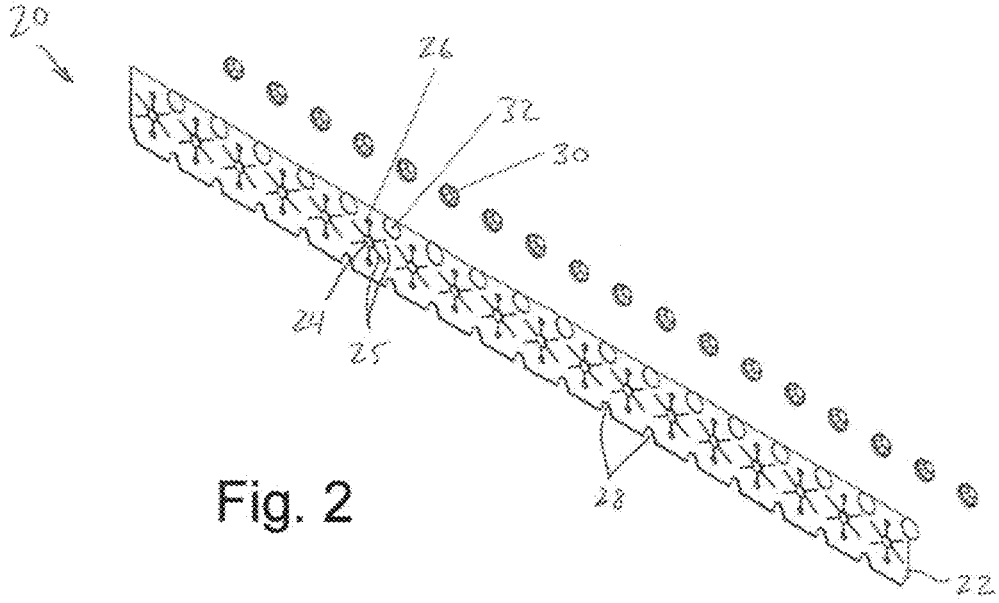
FIG. 2 is an exploded perspective view of an exemplary dispenser in the form of a belt.
Figure 3:
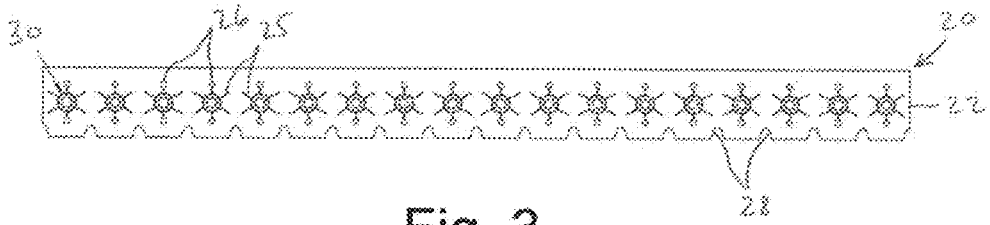
FIG. 3 is a front elevation view of the belt of FIG. 2.
Figure 4:
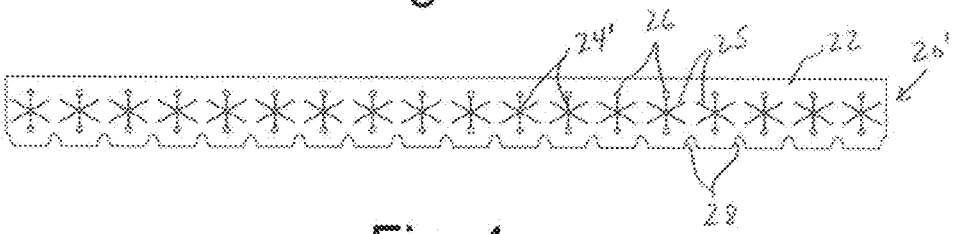
FIG. 4 is a rear elevation view of another exemplary belt.

Referring to FIGS. 2-4, exemplary gem dispensers 20, 20' in the form of belts 22 will be described. Each belt 22 is a strip with a series of spaced apart gem openings 24, 24'. The size of the openings 24, 24' are preferably selected to correspond to the size of the gem 30. For example, the belt 22 of FIGS. 2 and 3 would supports gems 30 which are larger than the gems supported on the belt 22 of FIG. 4. In each case, the openings 24, 24' are preferably provided with a series of radial slits 25. Furthermore, some of the slits 25 may terminate in openings 26. The radial slits 25 and openings 26 allow the material of the belt 22 to deform as the gem 30 is pressed through the opening 24, 24' and thereby guide the gem 30 to the application material (hair, paper, cloth, etc.). The shape also prevents the belt from sticking to the plunger. The shape of the gem mounting can be modified to accommodate different sizes and shapes of gems.

As illustrated in FIG. 2, an adhesive material 32 is positioned on the back surface of each gem 30 to facilitate adhering of the gem 30 to the intended surface. An exemplary adhesive material 32, when the gems 30 are applied to hair, is 3M 1522 acrylic adhesive. In at least one embodiment, the belt 22 is polystyrene material with a polyester non-stick coating. The coating is designed to partially adhere to the acrylic adhesive material 32 on the gem 30. Other exemplary belt materials include polyester, polycarbonate, paper, styrene, acrylic, polyethylene, polypropylene, and many other polymers. Exemplary coatings include polyester, silicone, fluorinated materials, olefin materials, and other materials that resist adhesion by acrylic adhesives.

Figure 5:
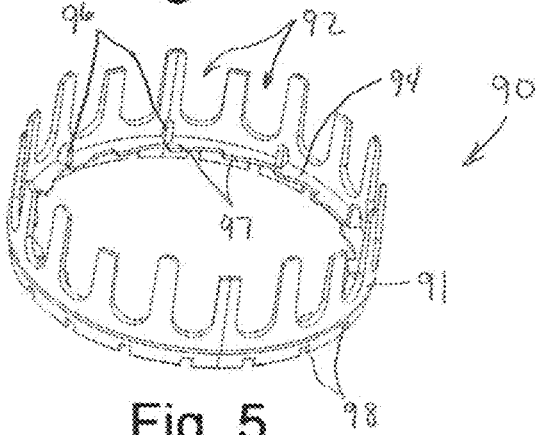
FIG. 5 is a perspective view of an exemplary belt drum of the applicator of FIG. 1.

The dispenser 20 is configured to be supported within the applicator 50 by a support assembly such that the gems 30 may be applied utilizing a mechanical application mechanism. In the present embodiment of the applicator assembly 10, the support assembly is a belt drum 90 as illustrated in FIG. 5. Each belt 22 is configured to be positioned within and supported by the belt drum 90. The belt drum 90 has a cylindrical body 91 with a series of drum openings 92, each of which aligns with a respective gem 30. A support surface 94 extends radially inward from the cylindrical body 91 to support the belt 22. To align the belt 22 and to ensure the belt 22 moves with the drum 90, the drum 90 includes a plurality of tabs 96 which engage corresponding notches 28 in the belt 22.

Figure 7:
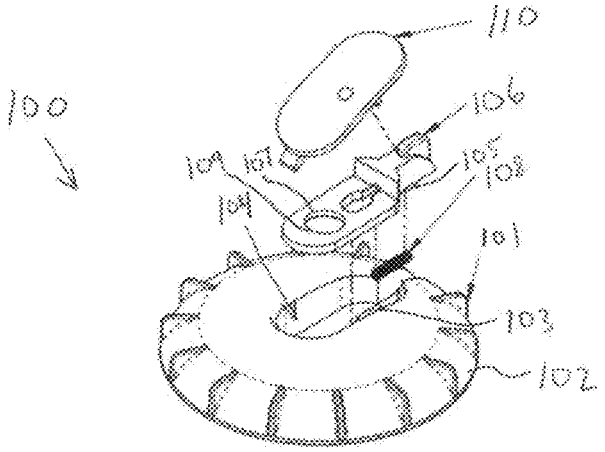
FIG. 7 is an exploded perspective view of an exemplary cover assembly of the applicator of FIG. 1.
Figure 8:
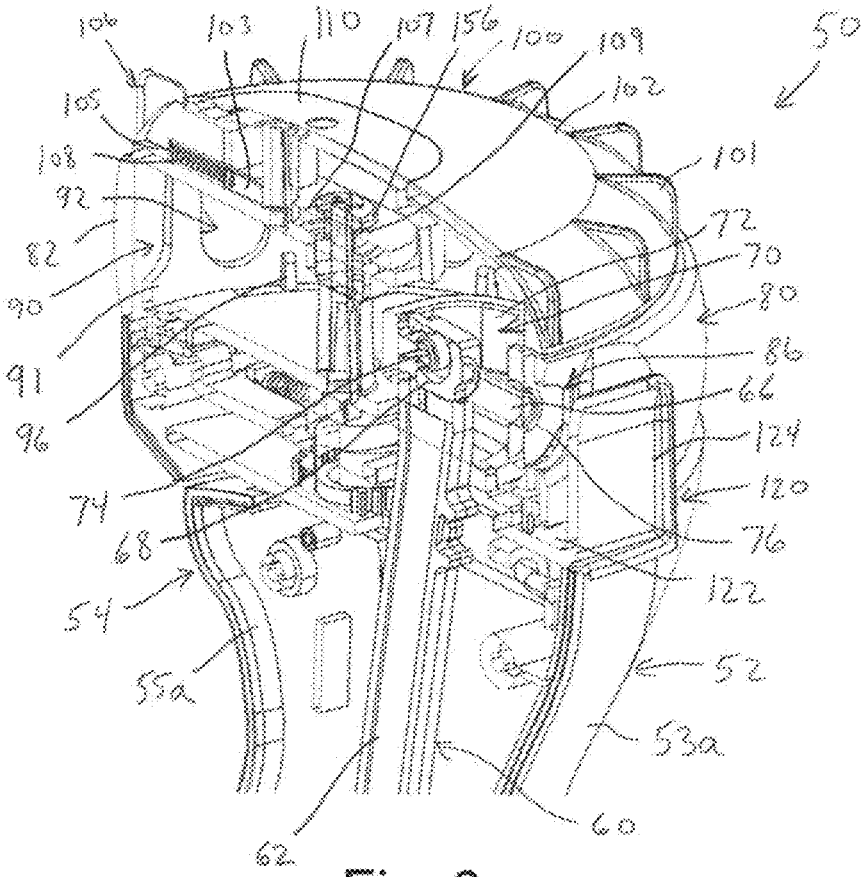
FIG. 8 is a cross-sectional view along the line 8-8 in FIG. 1.

Referring to FIGS. 6-8, the components of the gem applicator 50 of the present embodiment will be described. The exemplary applicator 50 generally includes: a handle body 52 to support all components, the drum 90 rotatably supported by the body 52, the drum cover 80 which extends about the drum 90 and may be formed integrally with or separately from the body 52 and which may be transparent, a removable cover assembly 100 to insert the belt and which may also be transparent and which may double up as a knob to turn the belt 22; (the transparent parts will allow the user to see what gems are still inside), the indexing mechanism 140 to automatically advance the belt 22 to each gem position for application, the trigger 54 to drive the plunger 60 to push the gem 30 through the opening 86 in the drum cover 80 and toward the backing plate 114 to apply the gem. The body 52 or trigger 54 may include a raised grip.

In the illustrated embodiment, the handle body 52 is formed by opposed body shell members 53*a*, 53*b*. The body shell members 53*a*, 53*b* may be joined to one another via screws, snap fit or in various other manners. The trigger 54 similarly comprises opposed trigger members 55*a*, 55*b* which are joined together to form the trigger. It is understood that both the body 52 and the trigger 54 may be made from more or fewer components. The trigger 54 is pivotally supported relative to the body 52 by, for example, a bushing 56.

The trigger 54 is configured to pivotally move the plunger 60. In the illustrated embodiment, the plunger 60 includes an axial body 62 extending between a pivot end 61 and a head 64. The pivot end 61 includes a through bore 63 configured to receive the bushing 56 such that the plunger 60 pivots with the trigger 54. The head 64 includes a push rod 66 which is configured to extend through a respective drum opening 92 and the drum cover opening 86 when the trigger is activated. With such movement, the push rod 66 engages the gem 30 and pushes it through the belt opening 24, 24', the drum opening 92 and the drum cover opening 86 where it is adhesively applied to the intended item at the drum cover opening 86.

A resilient member 70 engages the plunger 60 and is configured to biases the plunger 60 to an initial position withdrawn from the opening 86. In the illustrated embodiment, the resilient member 70 is a ring 72 made of elastomeric material, for example, rubber or the like. The resilient member 70 includes an inwardly protruding connector 76 which is configured to be received and retained in a corresponding groove 68 on the back of the plunger head 64. The opposite side of the ring 72 has a through hole 76 which aligns with the drum cover opening 86. When the plunger 60 is actuated, the ring 72 is compressed between the plunger head 64 and the inside of the drum 90 (see FIG. 8). Upon release of the trigger 54, the resilient nature of the ring 72 causes the plunger 60 to move to the initial position. While an elastomeric ring is illustrated, the resilient member 70 may have other configurations, for example, a spring or the like.

As described above, the plunger head 60 is surrounded by the drum 90 and the drum cover 80. The drum cover 80 preferably has a generally cylindrical body 82 although other configurations are possible. As illustrated, the area of the opening 86 preferably includes a flattened area 85 of the body 82. Tabs 84 extend from the bottom edge of the body 82 and are configured for connection to the body 52, however, other mechanism of attachment may be utilized.

Alternatively, the drum cover 80 may be formed integrally with the body 52. The drum 90 is rotatably positioned within the drum cover 80. In the illustrated embodiment, the drum 90 is positioned on a support surface 152 of an upper plate 150 of the indexing assembly 140. The upper plate 150 supports a plurality of drum rollers 154 which assist the rotation of the drum 90.

To access the drum cover 90 and to position belts 22 within the drum cover 80, the cover assembly 100 includes a removable cover 102. In the illustrated embodiment, the cover 102 includes a series of radial projections 101 which assist with manual rotation of the cover 102, and thereby the drum 90. The cover 102 defines an internal slot 104 into which a release button 106 is positioned. A spring 108 is positioned between a tab 103 in the slot 104 and a tab 105 on the release button 106 to bias the release button radially outward. The release button 106 has a through passage 107 with an inner contact surface 109.

Figure 9:
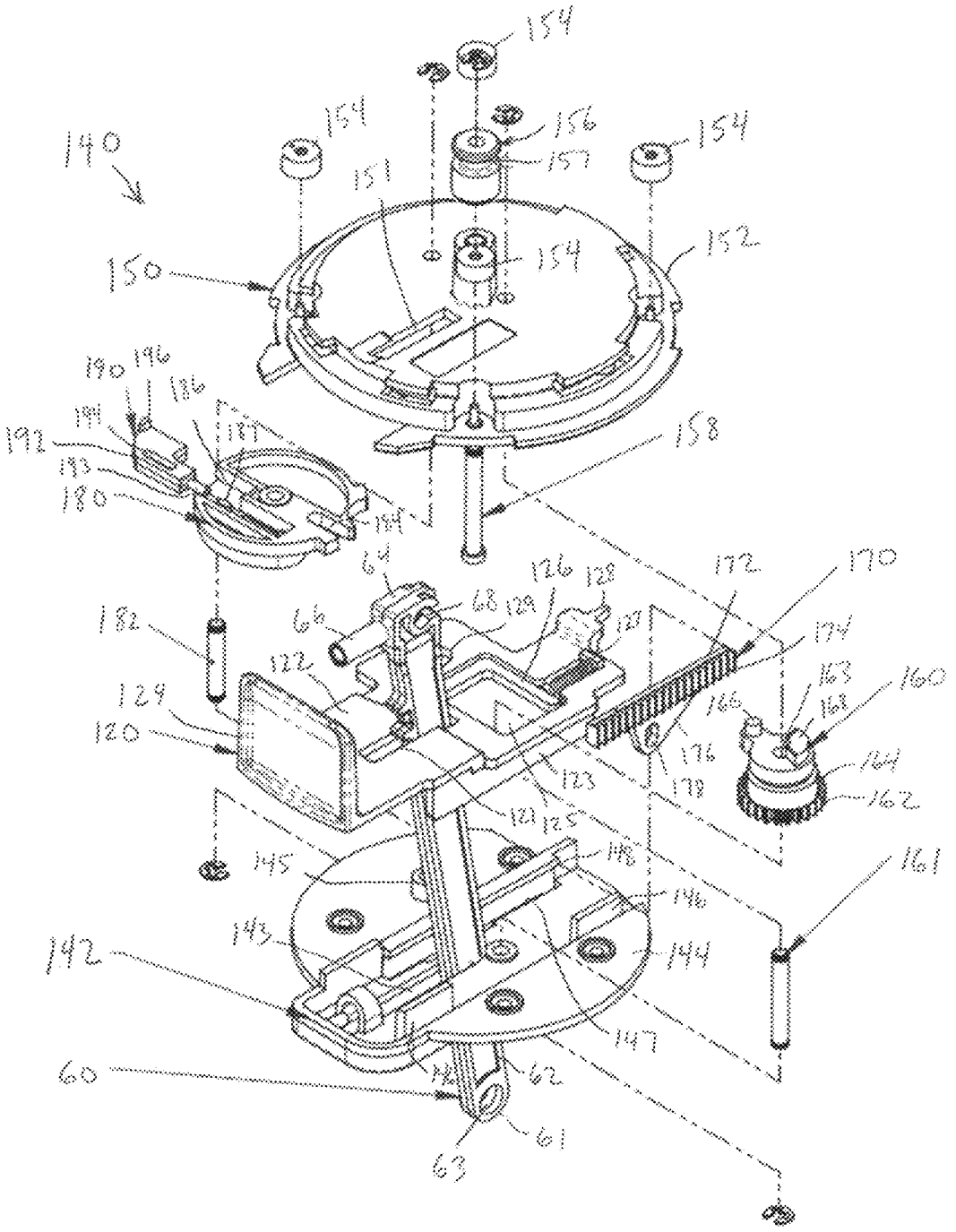
FIG. 9 is an exploded perspective view of an exemplary indexing assembly of the applicator of FIG. 1.

Referring to FIGS. 8 and 9, the through passage 107 is configured such that an internal top bearing 156, which is positioned on a center pivot pin 158 extending from the upper plate 150 and which defines a retaining groove 157, extends through the passage 107 with the groove 157 aligned with the inner contact surface 109. When the release button 106 is in its normal position due to the bias of the spring 108, the inner contact surface 109 is received in the groove 157 and the cover assembly 100 is axially secured relative to the drum cover 80 and body 52. The cover 102 is still free to rotate relative to the drum cover 80 as the push button 106 simply rotates about the top bearing 156. To remove the cover 102, the release button 106 is pressed radially inward such that the inner contact surface 109 is disengaged from the groove 157 and the top bearing 156 is aligned with the through passage 107 such that the cover may be lifted off. A cover plate 110 may extend over the slot 104.

Figure 10:
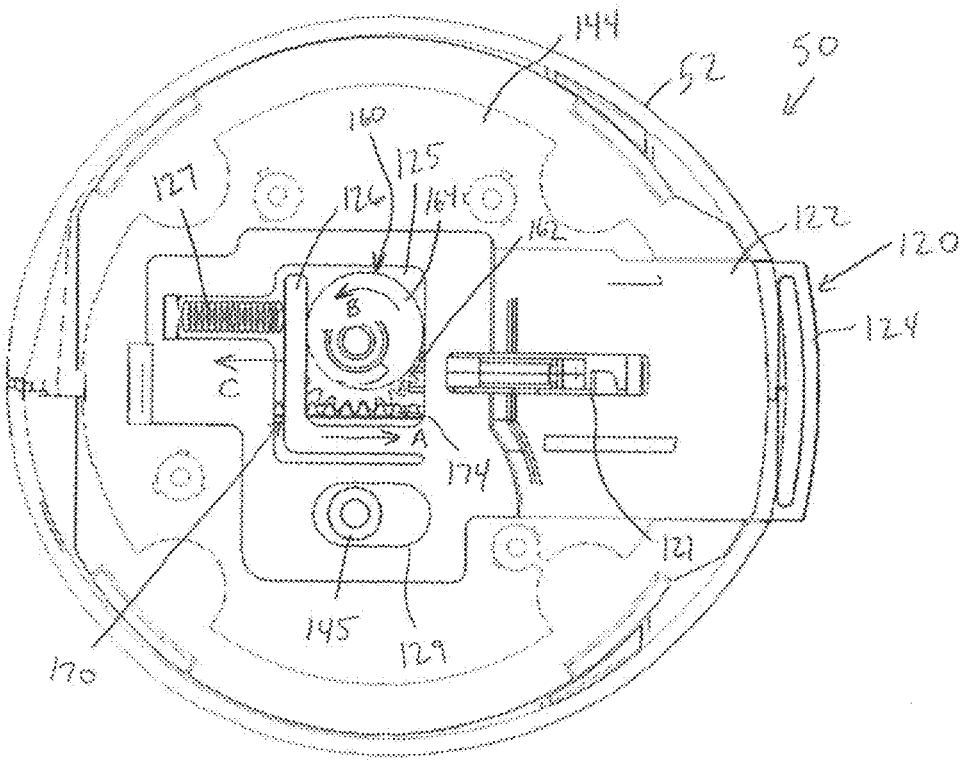
FIG. 10 is a cross-sectional view along the line 10-10 in FIG. 1.

Turning to FIGS. 8-10, an exemplary backing plate assembly 120 and indexing assembly 140 will be described. The backing plate assembly 120 includes a body 122 which extends into the handle body 52 and a backing plate 124 which extends generally perpendicular to the body 122, outside of the handle body 52 in alignment with the drum cover opening 86. The backing plate 124 provides a generally rigid support surface as the gem 30 is applied. In the illustrated embodiment, the indexing assembly 140 is configured to advance the drum 90 each time the trigger 54 is actuated and to also move the backing plate 124 toward the plunger push rod 66 while the trigger 54 is pressed to reduce the gap between the backing plate 124 and the drum cover 80.

The initial position of the backing plate 124 allows the user to add materials including hair, paper, cloth, etc. into the gap formed by the backing plate 124 and drum cover 80 with a relatively wider opening. When the trigger 54 is pressed, the backing plate 124 moves toward the plunger 60, providing a reliable support surface. As the trigger is released, the backing plate 124 returns to the open position to allow the user to remove the material with the gem applied. By opening the gap between the drum cover 80 and backing plate 124, the applied gem can clear the drum cover 80 and plunger 60 and be removed without being stripped from the material.

Referring to FIG. 9, the backing plate assembly body 122 includes downwardly extending rails 123 which engage upwardly extending rails 146, 148 of the bottom plate 142 of the indexing assembly 140 to guide axial movement thereof. The backing plate assembly body 122 may also include a slot 129 which receives a pin 145 extending from the bottom plate 142 to define the axial range of motion of the backing plate assembly 120. It is noted that the backing plate assembly body 122, the bottom plate 142, and the upper plate 150 have respective slots 121, 143, 151 through which the plunger 60 extends and is movable within.

In the present embodiment, the movement of the backing plate assembly 120 is facilitated by a cam gear 160 and a gear rack 170 of the indexing assembly 140. The gear rack 170 has a linear body 172 with a plurality of teeth 174 extending therefrom. The gear rack 170 is configured to move along the bottom plate 142 and is supported against one of the rails 148. A flange 176 extends from the linear body 172 and extends through a slot 147 in the bottom plate 142 such that a bore 178 in the flange 176 is below the bottom plate 142 and extends into the trigger 54. A bushing 58 within the trigger 54 (see FIG. 6) extends through the bore 178 such that movement of the trigger 54 causes linear movement of the gear rack 170.

The cam gear 160 includes a plurality of circumferential teeth 162. The cam gear 160 is rotatably mounted on the bottom plate 142 via a cam gear pin 161 and is aligned such that the circumferential teeth 162 engage the gear rack teeth 174. As such, as the trigger 54 is moved, the cam gear 160 is rotated in response thereto. The cam gear 160 includes an eccentric body portion 164 above the teeth 162 that extends through an opening 125 in the backing plate assembly body 122 and aligns with an arm 126. Referring to FIG. 10, when the trigger 54 is depressed, the gear rack 170 moves as indicated by arrow A, which in turn causes the cam gear 160 to rotate as indicated by arrow B. As the cam gear 160 rotates, the eccentric body portion 164 engages the arm 126, thereby causing the backing plate assembly body 122 and backing plate 124 to move in the direction of arrow C. When the trigger 54 is released, the gear rack 170 and cam gear 160 move in the opposite direction, returning the backing plate 124 to the original position.

It is noted that the arm 126 and spring 127 in the illustrated embodiment provide flexibility. Since the material may have different thickness, the spring 127 allows the backing plate assembly 120 to accommodate thin or thick material without damaging the mechanism. If a thick piece of material is placed in the backing plate gap, as cam gear rotates, the backing plate assembly body 122 will not be able to move, however, the arm 126 will simply push against and compress the spring 127 rather than moving the backing plate. When thinner material is placed in the gap, the spring 127 is not compressed and the backing plate 124 moves in response to the cam gear 160.

Figure 11:
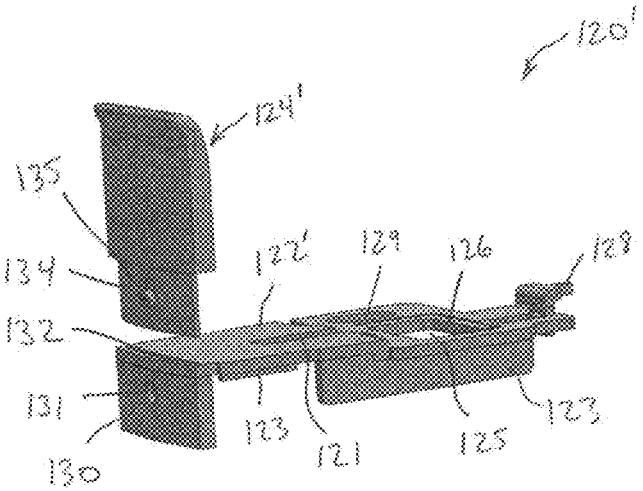
FIG. 11 is a perspective view of alternative backing plate assembly in accordance with an embodiment of the disclosure.

Referring to FIG. 11, an alternative backing plate assembly 120' is illustrated. The backing plate assembly 120' is substantially the same as in the previous embodiment except that the backing plate 124' is removable. A removable backing plate 124' allows the applicator 50 to be used to apply gems to a material which would not fit in the gap between the drum cover 80 and backing plate 124'. In the illustrated embodiment, the backing plate assembly body 122' includes a rear body portion 130 with a receiving slot 132 defined therein. A locking hole 131 extends through the rear body portion 130 into communication with the receiving slot 132. The removable backing plate 124' includes a depending tab 134 which is configured to be received in the receiving slot 132. A locking projection 134 extends from the tab 134 and is configured to engage within the locking hole 131 to lock the removable backing plate 124' to the back plate assembly body 122'. To remove the removable backing plate 124', the locking projection 134 is depressed until it clears the locking hole 131. Other removable connection assemblies are contemplated, for example, a snap fit, a friction fit, a dovetail connection, or a threaded connection. Other than described, the backing plate assembly 120' functions in a similar manner to the previously described embodiment.

Referring to FIGS. 9 and 12-14, the indexing function of the indexing assembly 140 will be described. The cam gear 160 further supports an indexing pin 166 which moves when the circumferential teeth 162 are engaged by the gear rack teeth 174. The indexing pin 166 is received within an index slot 184 of the indexing arm support 180. The indexing arm support 180 is pivotally supported relative to the bottom plate 142 via a pin 182. The indexing arm support 180 defines a slot 186 configured to receive the indexing arm 190 and guide reciprocal axial motion thereof. The indexing arm 190 includes a body 192 with a guide slot 194 which receives a tab 187 extending within the slot 186. Engagement of the tab 187 within the guide slot 194 defines the axial range of motion of the indexing arm 190. The indexing arm body 192 includes a post 193 configured to engage a spring 188 within the slot 186 such that the indexing arm 190 is biased radially outward. An engagement surface 196 is defined on the outer portion of the indexing arm 190. The engagement surface 196 is configured to engage the inward ramped surfaces 97 of the drum 90. Upon engaging the flat portion of the ramped surfaces 97, the engagement surface 196 causes the drum 90 to rotate. When moving in the opposite direction, i.e. during release of the trigger or when the drum is rotated manually, and engaging the tapered portion of the ramped surfaces 97, the spring 188 allows the indexing arm 190 to move radially inward and ride over the ramped surfaces 97. A block 168 extending from the cam gear 160 defines a rotational stop in both directions for the indexing arm support 180.

Figure 12:
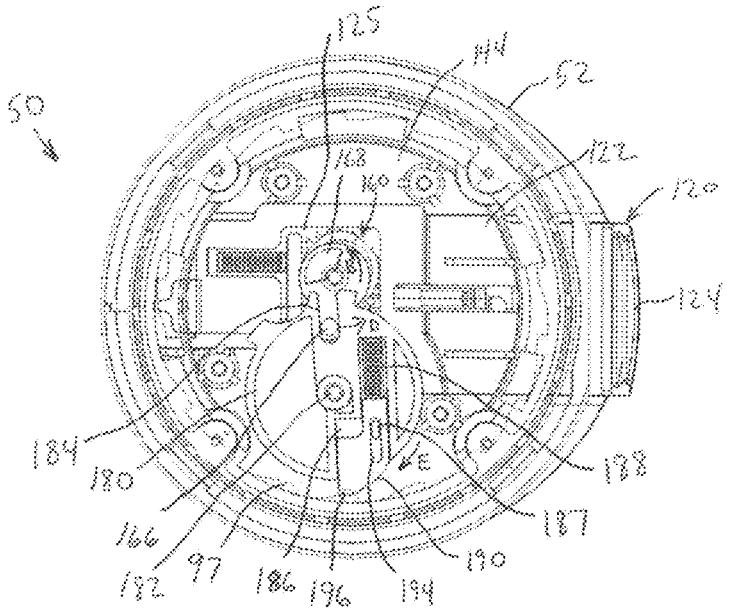
FIG. 12 is a cross-sectional view along the line 12-12 in FIG. 1.

In operation, when the trigger 54 is actuated, the cam gear 160 rotates in the direction indicated by arrow B in FIG. 12 which in turn causes the indexing pin 166 to move in the direction indicated by arrow D. As the indexing pin 166 moves along the index slot 184 of the indexing arm support 180, the indexing arm support 180 rotates in the direction indicated by arrow E, thereby moving the engagement surface 196 of the indexing arm 190 to engage the flat portion of the next ramped surface 97, which in turn causes the drum 90 to automatically rotate and move the next gem into position.

Figure 13:
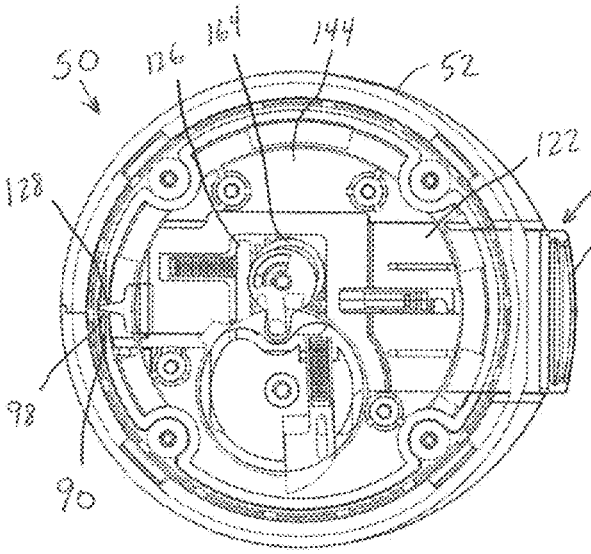
FIG. 13 is a cross-sectional view along the line 13-13 in FIG. 1.
Figure 14:
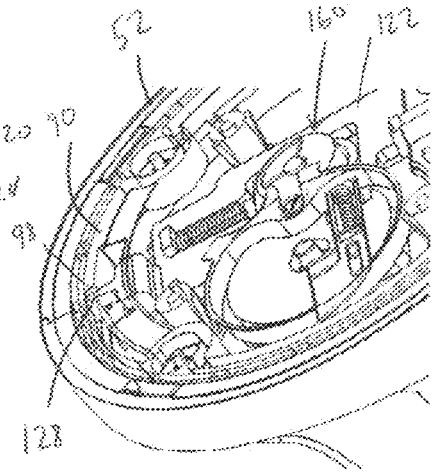
FIG. 14 is a perspective view of the applicator as illustrated in FIG. 13.

To hold the drum 90 in place during application, a holding pin 128 is configured to engage a respective notch 98 of the drum 90 when the trigger is actuated as illustrated in FIGS. 13 and 14. In the illustrated embodiment, the holding pin 128 is formed integral with the backing plate assembly body 122 and moves when the trigger 54 is actuated. The holding pin 128 may be formed as a separate component. The holding pin 128 moves into engagement with the drum notch 98 when the indexing motion is complete. This centers the gem 30 in preparation for application and holds the drum 90 in place while the gem 30 is applied. The pin 128 is retracted, allowing the drum 90 to move, when the trigger 54 is released.

Having generally described the components, an exemplary method of applying and indexing the gems will be described. The actuating trigger initially moves the gem to the application position. Further trigger movement pushes the gem from the belt to a material (hair, paper, cloth). Further trigger movement applies the gem to the material. Releasing the trigger resets the belt indexing mechanism.

In the illustrated embodiment, the applicator 50 can index up to 18 gems. The applicator 50 and belt 22 can be configured to index more or fewer gems. The belt can be in a ring or linear strip configuration. The belt can be removed and a new one re-loaded to provide more gems. No heat or electricity is required to apply or index gems. Other configurations of the applicator assembly 10 could use dispensers in the form of rings, linear strips, or disks to carry the gems.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A gem applicator assembly comprising:

a dispenser supporting a plurality of gems, each gem having an adhesive backing; and an applicator comprising:

a body;

a support assembly supported by the body and configured to receive and support the dispenser with one of the gems aligned with an application target area; and a plunger having a push rod, the plunger supported by the body and movable relative thereto between an initial position and an application position wherein the push rod engages the aligned gem and pushes the gem such that the adhesive backing of the aligned gem moves toward the application target area.

2. The gem applicator assembly according to claim 1 wherein the plunger is biased to the initial position by a resilient member.

3. The gem applicator assembly according to claim 2 wherein the resilient member includes a ring made of elastomeric material.

4. The gem applicator assembly according to claim 1 wherein the applicator further comprises a backing plate positioned proximate the application target area.

5. The gem applicator assembly according to claim 4 wherein the backing plate is removable.

6. The gem applicator assembly according to claim 4 wherein the backing plate is configured to move toward the push rod as the plunger moves toward the application position.

7. The gem applicator assembly according to claim 6 wherein the applicator further comprises a trigger supported by the body, wherein actuation of the trigger moves the plunger from the initial position to the application position and simultaneously causes the backing plate to move toward the push rod.

8. The gem applicator assembly according to claim 7 wherein actuation and release of the trigger causes automatic indexing of the support assembly such that a next one of the gems is aligned with an application target area.

9. The gem applicator assembly according to claim 1 wherein the applicator further comprises a trigger supported by the body, wherein actuation of the trigger moves the plunger from the initial position to the application position and wherein actuation and release of the trigger causes automatic indexing of the support assembly such that a next one of the gems is aligned with an application target area.

10. The gem applicator assembly according to claim 9 wherein the support assembly may also be manually indexed.

11. The gem applicator assembly according to claim 9 wherein a pin is engaged relative to the support assembly and the body to prevent movement of the support assembly until the next indexing thereof.

12. The gem applicator assembly according to claim 1 wherein the support assembly is a drum rotatably supported relative to the body.

13. The gem applicator assembly according to claim 12 wherein the dispenser is a belt positionable within the drum.

14. The gem applicator assembly according to claim 12 wherein a drum cover extends about the drum, the drum cover defining an opening aligned with the application target area.

15. The gem applicator assembly according to claim 14 wherein the drum cover is transparent.

16. The gem applicator assembly according to claim 14 wherein a cover assembly is removably secured relative to the drum cover to enclose the drum and dispenser.

17. The gem applicator assembly according to claim 16 wherein the cover assembly is rotatable relative to the drum cover, wherein rotation of the cover assembly causes rotation of the drum.

18. A gem dispenser comprising:

a belt having a strip configuration;

a plurality of spaced apart gem openings extending through the belt; and a plurality of adhesive backed gems positioned on the belt, each gem aligned with a respective gem opening.

19. The gem dispenser according to claim 18 wherein the belt is coated with an adhesion resistant material.

20. The gem dispenser according to claim 18 wherein the gem openings are sized to slightly smaller than a size of a respective gem positioned aligned therewith.

21. The gem dispenser according to claim 18 wherein a plurality of radial slits extend from each gem opening.

22. The gem dispenser according to claim 21 wherein at least one of the radial slits includes a secondary opening at an end thereof spaced from the respective gem opening.

* * * * *